US007549268B2

(12) United States Patent
Kim

(10) Patent No.: US 7,549,268 B2
(45) Date of Patent: Jun. 23, 2009

(54) DIVISION-PACKAGING METHOD AND APPARATUS FOR AUTOMATIC MEDICINE PACKAGING MACHINE

(75) Inventor: Jun Ho Kim, Daegu (KR)

(73) Assignee: JVM Co., Ltd., Taegu (KR)

( * ) Notice: Subject to any disclaimer, the term of this patent is extended or adjusted under 35 U.S.C. 154(b) by 256 days.

(21) Appl. No.: 11/739,045

(22) Filed: Apr. 23, 2007

(65) Prior Publication Data

US 2008/0149522 A1 Jun. 26, 2008

(30) Foreign Application Priority Data

Dec. 22, 2006 (KR) ..... 10-2006-0133149

(51) Int. Cl.
*B65B 61/02* (2006.01)
*B65B 3/30* (2006.01)
*B65B 43/04* (2006.01)

(52) U.S. Cl. ..... 53/411; 53/455; 53/503

(58) Field of Classification Search ..... 53/411, 53/455, 467, 469, 503, 504, 562; 700/240
See application file for complete search history.

(56) References Cited

U.S. PATENT DOCUMENTS

| | | | |
|---|---|---|---|
| 169,935 | A | 11/1875 | Whitman |
| 350,675 | A | 10/1886 | Hathaway |
| 488,721 | A | 12/1892 | Stempel |
| 1,121,804 | A | 12/1914 | Coulson |
| 1,270,756 | A | 6/1918 | Holmberg |
| 1,912,248 | A | 5/1933 | Bateman et al. |
| 2,005,496 | A | 6/1935 | Donovan et al. |
| 2,181,314 | A | 11/1939 | Burns |
| 2,208,951 | A | 7/1940 | Tamassy |
| 2,255,036 | A | 9/1941 | Gedge |
| 2,449,139 | A | 9/1948 | Posner |
| 2,710,712 | A | 6/1955 | Friedman |
| 2,712,883 | A | 7/1955 | Esposito et al. |
| 2,918,069 | A | 12/1959 | Brown, Jr. et al. |
| 2,994,996 | A | 8/1961 | Klar |
| 3,074,214 | A | 1/1963 | Schneider et al. |
| 3,227,127 | A | 1/1966 | Gayle |
| 3,263,857 | A | 8/1966 | Krakauer et al. |
| 3,348,392 | A | 10/1967 | Schreiber |
| 3,408,876 | A | 11/1968 | Andrews |

(Continued)

FOREIGN PATENT DOCUMENTS

| | | |
|---|---|---|
| GB | 2178397 | 2/1987 |

(Continued)

*Primary Examiner*—Louis K Huynh
(74) *Attorney, Agent, or Firm*—John K. Park; Park Law Firm

(57) ABSTRACT

A division-packaging method for an automatic medicine packaging machine that allows stable packaging even when total volume of each dose of medication for making a package is bigger than packaging volume of any medication envelope established in the automatic medicine packaging machine and that prevents incapability of packaging due to excess volume of each dose of medication. The method includes step of acquiring packaging volume of each medication envelope; step of computing total volume of each dose of medication; step of judging excess volume of each dose of medication; and step of division-packaging each dose of medication when the total volume of each dose of medication for making a package is bigger than the packaging volume of any medication envelope established in the automatic medicine packaging machine.

4 Claims, 3 Drawing Sheets

U.S. PATENT DOCUMENTS

| | | | | |
|---|---|---|---|---|
| 3,410,452 | A | 11/1968 | Igel et al. | |
| 3,481,103 | A | 12/1969 | Summerour | |
| 3,546,849 | A | 12/1970 | Zimmerman | |
| 3,562,475 | A | 2/1971 | Angelotti et al. | |
| 3,604,559 | A | 9/1971 | McCall et al. | |
| 3,712,019 | A * | 1/1973 | Lamka et al. | 53/503 |
| 3,774,368 | A | 11/1973 | Paprzycki | |
| 3,820,655 | A | 6/1974 | La Tourette et al. | |
| 3,830,419 | A | 8/1974 | Lee | |
| 3,842,569 | A | 10/1974 | McClelland et al. | |
| 3,850,780 | A | 11/1974 | Crawford et al. | |
| 3,861,651 | A | 1/1975 | Takamura | |
| 3,871,156 | A | 3/1975 | Koenig et al. | |
| 3,921,419 | A | 11/1975 | Rosenkranz et al. | |
| 3,990,209 | A | 11/1976 | Eisenberg | |
| 4,019,547 | A | 4/1977 | Ross | |
| 4,149,394 | A | 4/1979 | Sornes | |
| 4,209,211 | A | 6/1980 | Alford | |
| 4,244,158 | A | 1/1981 | Nelham | |
| 4,254,601 | A | 3/1981 | Prager et al. | |
| 4,267,942 | A | 5/1981 | Wick, Jr. et al. | |
| 4,382,527 | A | 5/1983 | Lerner | |
| 4,506,492 | A * | 3/1985 | Boyd | 53/503 |
| 4,519,179 | A | 5/1985 | Meier | |
| 4,534,499 | A | 8/1985 | Cox et al. | |
| 4,572,376 | A | 2/1986 | Wrennall | |
| 4,664,289 | A | 5/1987 | Shimizu et al. | |
| 4,696,392 | A | 9/1987 | Chisholm, Jr. | |
| 4,771,912 | A | 9/1988 | van Wingerden | |
| 4,790,118 | A | 12/1988 | Chilcoate | |
| 4,790,421 | A | 12/1988 | Gorges | |
| 4,811,764 | A | 3/1989 | McLaughlin | |
| 4,903,861 | A | 2/1990 | Yuyama | |
| 4,915,259 | A | 4/1990 | Guigan et al. | |
| 4,922,682 | A | 5/1990 | Tait et al. | |
| 4,955,178 | A | 9/1990 | Shroyer | |
| 5,069,511 | A | 12/1991 | Swets et al. | |
| 5,097,652 | A | 3/1992 | Inamura et al. | |
| 5,159,959 | A * | 11/1992 | Bohm | 53/503 |
| 5,219,095 | A | 6/1993 | Shimizu et al. | |
| 5,221,024 | A | 6/1993 | Campbell | |
| 5,318,430 | A | 6/1994 | Ramm | |
| 5,337,919 | A | 8/1994 | Spaulding et al. | |
| 5,348,061 | A | 9/1994 | Riley et al. | |
| 5,381,904 | A | 1/1995 | Thurell | |
| 5,383,559 | A | 1/1995 | Toren | |
| 5,413,245 | A | 5/1995 | Wright | |
| 5,441,165 | A | 8/1995 | Kemp et al. | |
| 5,459,983 | A | 10/1995 | Sadek et al. | |
| 5,481,855 | A | 1/1996 | Yuyama | |
| 5,487,289 | A | 1/1996 | Otto, III et al. | |
| 5,502,944 | A | 4/1996 | Kraft et al. | |
| 5,509,573 | A | 4/1996 | Campoli | |
| 5,522,525 | A | 6/1996 | McLaughlin et al. | |
| 5,575,465 | A | 11/1996 | Auerbach et al. | |
| 5,588,792 | A | 12/1996 | Tiso | |
| 5,599,015 | A | 2/1997 | Shimizu et al. | |
| 5,611,456 | A | 3/1997 | Kasper | |
| 5,626,219 | A | 5/1997 | Deefholts et al. | |
| 5,651,476 | A | 7/1997 | Percy et al. | |
| 5,660,305 | A | 8/1997 | Lasher et al. | |
| 5,667,096 | A | 9/1997 | Wu | |
| 5,671,592 | A | 9/1997 | Yuyama et al. | |
| 5,678,393 | A | 10/1997 | Yuyama et al. | |
| 5,709,063 | A | 1/1998 | Yuyama et al. | |
| 5,722,215 | A | 3/1998 | Yuyama | |
| 5,749,117 | A | 5/1998 | Forsline | |
| 5,765,606 | A | 6/1998 | Takemasa et al. | |
| 5,787,678 | A | 8/1998 | Koike et al. | |
| 5,797,248 | A | 8/1998 | Hetherington et al. | |
| 5,803,309 | A | 9/1998 | Yuyama et al. | |
| 5,819,500 | A | 10/1998 | Haraguchi et al. | |
| 5,839,257 | A | 11/1998 | Soderstrom et al. | |
| 5,852,911 | A | 12/1998 | Yuyama et al. | |
| 5,865,342 | A | 2/1999 | Ito et al. | |
| 5,875,610 | A | 3/1999 | Yuyama et al. | |
| 5,901,876 | A | 5/1999 | Yuyama et al. | |
| 5,927,546 | A | 7/1999 | Yuyama et al. | |
| 5,930,145 | A | 7/1999 | Yuyama et al. | |
| 5,944,057 | A | 8/1999 | Pierce | |
| 5,946,883 | A | 9/1999 | Yuyama et al. | |
| 5,963,453 | A | 10/1999 | East | |
| 5,964,374 | A | 10/1999 | Yuyama et al. | |
| 5,987,859 | A | 11/1999 | Dreger | |
| 6,012,602 | A | 1/2000 | Yuyama et al. | |
| 6,023,916 | A | 2/2000 | Bouthiette | |
| 6,029,683 | A | 2/2000 | Moebs et al. | |
| 6,050,064 | A | 4/2000 | Yuyama et al. | |
| 6,089,136 | A | 7/2000 | Hinojosa et al. | |
| 6,109,486 | A | 8/2000 | Lee, Jr. et al. | |
| 6,119,440 | A | 9/2000 | Benner, Jr. et al. | |
| 6,119,892 | A | 9/2000 | Laurent et al. | |
| 6,145,700 | A | 11/2000 | Takahashi et al. | |
| 6,164,038 | A | 12/2000 | Kim | |
| 6,170,229 | B1 | 1/2001 | Kim | |
| 6,170,230 | B1 | 1/2001 | Chudy et al. | |
| 6,170,699 | B1 | 1/2001 | Kim | |
| 6,179,205 | B1 | 1/2001 | Sloan | |
| 6,202,385 | B1 | 3/2001 | Kim | |
| 6,216,418 | B1 | 4/2001 | Kim | |
| 6,256,963 | B1 | 7/2001 | Kim | |
| 6,263,639 | B1 | 7/2001 | Kim | |
| 6,273,335 | B1 | 8/2001 | Sloan | |
| 6,308,494 | B1 | 10/2001 | Yuyama et al. | |
| 6,311,743 | B1 | 11/2001 | Baroncini | |
| 6,318,051 | B1 | 11/2001 | Preiss | |
| 6,349,848 | B1 | 2/2002 | Uema et al. | |
| 6,364,517 | B1 | 4/2002 | Yuyama et al. | |
| 6,367,232 | B2 | 4/2002 | Kim | |
| 6,394,308 | B1 | 5/2002 | Yuyama et al. | |
| 6,409,290 | B1 | 6/2002 | Lin | |
| 6,427,865 | B1 | 8/2002 | Stillwell et al. | |
| 6,449,921 | B1 | 9/2002 | Kim | |
| 6,457,611 | B1 | 10/2002 | Koehler | |
| 6,471,089 | B2 | 10/2002 | Liff et al. | |
| 6,471,090 | B1 | 10/2002 | Inamura et al. | |
| 6,474,048 | B1 * | 11/2002 | Metzger et al. | 53/503 |
| 6,478,185 | B2 | 11/2002 | Kodama et al. | |
| 6,481,180 | B1 | 11/2002 | Takahashi et al. | |
| 6,508,279 | B2 | 1/2003 | Siegel et al. | |
| 6,540,101 | B1 | 4/2003 | Kim | |
| 6,581,356 | B2 | 6/2003 | Kim | |
| 6,585,132 | B2 | 7/2003 | Kim | |
| 6,604,019 | B2 | 8/2003 | Ahlin et al. | |
| 6,611,733 | B1 | 8/2003 | De La Huerga | |
| 6,644,504 | B2 | 11/2003 | Yuyama et al. | |
| 6,647,702 | B1 | 11/2003 | Kim | |
| 6,722,167 | B1 | 4/2004 | Hsu | |
| 6,772,907 | B2 | 8/2004 | Kim | |
| 6,786,356 | B2 | 9/2004 | Geiger et al. | |
| 6,792,736 | B1 | 9/2004 | Takahashi et al. | |
| 6,805,259 | B2 | 10/2004 | Stevens et al. | |
| 6,898,919 | B2 | 5/2005 | Kim | |
| 6,955,029 | B2 * | 10/2005 | Palumbo | 53/504 |
| 7,028,447 | B2 | 4/2006 | Sung | |
| 7,059,098 | B2 | 6/2006 | Kim | |
| 7,331,151 | B2 | 2/2008 | Kim | |
| 2002/0092275 | A1 | 7/2002 | Kim | |
| 2003/0057225 | A1 | 3/2003 | Kim | |
| 2003/0074868 | A1 | 4/2003 | Yasuoka et al. | |
| 2004/0046020 | A1 | 3/2004 | Andreasson et al. | |
| 2004/0129716 | A1 | 7/2004 | Naufel et al. | |
| 2004/0182044 | A1 | 9/2004 | Kim | |
| 2005/0179349 | A1 | 8/2005 | Booth et al. | |

2005/0234430 A1 10/2005 Mao et al.
2006/0041330 A1* 2/2006 Ansari et al. ..... 700/240
2006/0058918 A1 3/2006 Handfield et al.
2006/0070352 A1 4/2006 Momich
2006/0139148 A1 6/2006 Faro et al.
2006/0267727 A1 11/2006 Cayne et al.
2006/0273106 A1 12/2006 Kim
2007/0016327 A1 1/2007 Yuyama et al.
2007/0078562 A1 4/2007 Park
2007/0125100 A1 6/2007 Shoenfeld
2007/0151204 A1 7/2007 Kim
2007/0208595 A1 9/2007 Ohmura et al.
2007/0257773 A1 11/2007 Hill et al.

FOREIGN PATENT DOCUMENTS

JP 9-175510 7/1997
JP 9-266940 10/1997

* cited by examiner

DIVISION-PACKAGING METHOD AND APPARATUS FOR AUTOMATIC MEDICINE PACKAGING MACHINE

CLAIMING FOREIGN PRIORITY

The applicant claims and requests a foreign priority, through the Paris Convention for the Protection of Industrial Property, based on patent applications filed in the Republic of Korea (South Korea) with the filing date of Dec. 22, 2006, with the patent application number 10-2006-0133149 by the applicant, the contents of which are incorporated by reference into this disclosure as if fully set forth herein.

BACKGROUND OF THE INVENTION

The present invention relates to an automatic medicine packaging machine that packages each dose of medication. Specifically, the present invention relates to division-packaging method and apparatus for an automatic medicine packaging machine that allow stable packaging even when total volume of each dose of medication for making a package is bigger than packaging volume of any medication envelope established in the automatic medicine packaging machine and that prevent incapability of packaging due to excess volume of each dose of medication.

In general, an automatic medicine packaging machine continuously packages tablet-type medications that are dispensed per dose. The construction and operation of an automatic medicine packaging machine are explained as follows referring to FIG. 3. An automatic medicine packaging machine includes a plurality of tablet cassettes 100 that is built on a shelf in the upper part of the machine, a tablet dispenser 200 in the lower part, a hopper 300 that is constructed below the tablet cassettes 100 and the tablet dispenser 200, a printing unit 400, and a sealing unit 500 that feeds and seals medication envelopes on which instruction labels are printed by the printing unit 400.

The operation of the tablet cassettes 100, the printing unit 400, and the sealing unit 500 are controlled by a controller C that is installed inside the machine. The controller C operates to export each dose of medication from the tablet cassettes to a medication envelope via hopper according to the prescription data inputted from a computer server S. Each dose of medication exported to a medication envelope forms a medication package by heat-sealing process with the sealing unit 500.

However, the above prior art has a disadvantage as follows: Because medication packages that will be formed by the heat-sealing process of the sealing unit 500 have constant packaging sizes, that is, constant volumes of medication envelopes, the packaging of each dose of medication may not be stably achieved or it may not be possible to make a package when the total volume of each dose of medication extracted from the tablet cassettes for making a package is bigger than the packaging volume of any medication envelope established in the automatic medicine packaging machine.

SUMMARY OF THE INVENTION

The present invention contrives to solve the above disadvantage of the prior art.

An objective of the invention is to provide division-packaging method and apparatus for an automatic medicine packaging machine that allow stable packaging even when total volume of each dose of medication for making a package is bigger than packaging volume of any medication envelope established in an automatic medicine packaging machine and that prevent incapability of packaging due to excess volume of each dose of medication.

Another objective of the invention is to provide division-packaging method and apparatus that each division-packaged medication package is smoothly perceived and differentiated.

In order to accomplish the above objectives the present invention provides a division-packaging method for an automatic packaging machine based on a preferred embodiment. The method includes step of acquiring packaging volume of each medication envelope, wherein, after extracting packaging size of each medication envelope, the packaging volume of each medication envelope corresponding to the extracted packaging size is acquired from data of packaging volumes of medication envelopes that are preserved in advance; step of computing total volume of each dose of medication, wherein, after extracting name and number of each dose of medication from prescription data inputted from a server computer, the total volume of each dose of medication for making a package is computed by acquiring data of total volumes of medications which are preserved in advance; step of judging excess volume of each dose of medication, wherein the judgment of excess volume of each dose of medication is performed by comparing the acquired packaging volume of each medication envelope with the computed total volume of each dose of medication; and step of division-packaging each dose of medication into two or more medication envelopes when the total volume of each dose of medication for making a package is bigger than the packaging volume of any medication envelope established in the automatic medicine packaging machine.

The method further includes step of indicating division-packaging status on each division-packaged medication envelope. The indication of the division-packaging status is performed by printing on the fronts of the two or more medication envelopes of each medication package.

The method further includes step of displaying existence of division-packaged medication packages after the step of division-packaging each dose of medication into the two or more medication envelopes.

In order to accomplish the above objectives of the invention, based on a preferred embodiment a division-packaging apparatus for an automatic packaging machine that continuously packages each dose of medication fed into medication envelope(s) is developed, wherein the automatic medicine packaging machine comprises a plurality of tablet cassettes that houses medications, a printing unit that prints instruction labels on medication envelopes, and a sealing unit that feeds and seals medication envelopes on which instruction labels are printed by the printing unit. The apparatus includes a controller for the automatic medicine packaging machine which controls the tablet cassettes, the printing unit, and the sealing unit of the automatic medicine packaging machine according to prescription data inputted from a server computer. The apparatus further includes a storage unit that is connected to the controller and that stores data of packaging volumes of medication envelopes corresponding to each packaging size of the medication envelope and data of total volumes of medications housed in the tablet cassettes, wherein the controller controls to divide and package each dose of medication into two or more packaging envelopes by volume comparison and analysis if total volume of each dose of medication for making a package is bigger than packaging volume of any medication envelope after acquiring from the storage unit the total volume of each dose of medication and the packaging volume of medication envelopes corresponding to each packaging size established in the automatic packaging machine.

In addition, the controller controls the printing unit to print division-packaging status on the fronts of the two or more medication envelopes in which each dose of medication is divided and packaged.

The present invention has an advantageous effect that allows stable packaging even when the total volume of each dose of medication for making a package is bigger than the packaging volume of any medication envelope established in the automatic medicine packaging machine and that prevent the incapability of packaging due to the excess volume of each dose of medication.

The present invention has additional effect that each division-packaged medication package is smoothly perceived and differentiated.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENT

Figure 1:
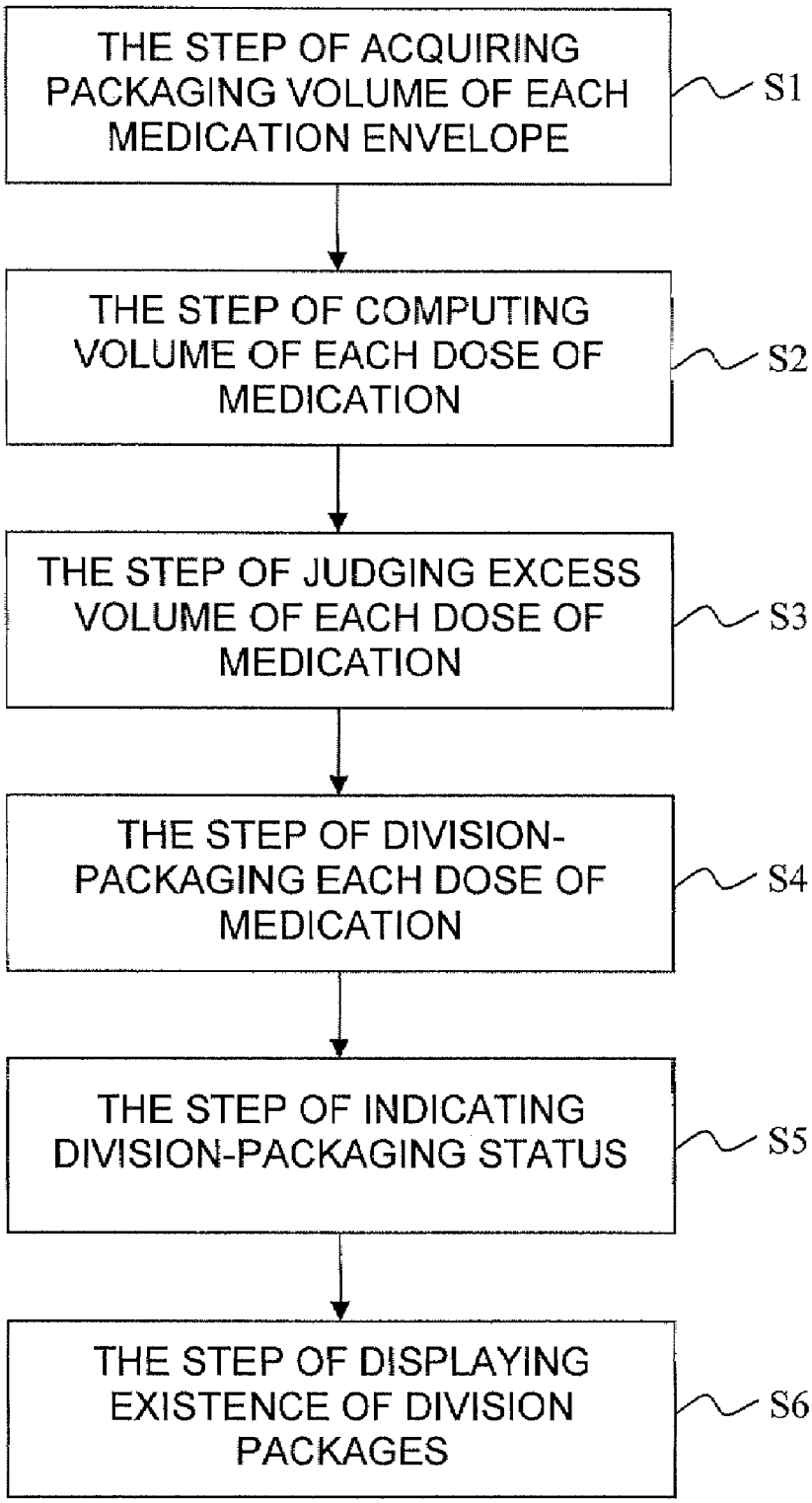
FIG. 1 is a flow diagram of a method for division-packaging for an automatic medicine packaging machine according to the present invention.

FIG. 1 shows a division-packaging method for an automatic medicine packaging machine according to the present invention. The method includes step S1 of acquiring packaging volume of each medication envelope, step S2 of computing total volume of each dose of medication, step S3 of judging excess volume of each dose of medication, and step S4 of division-packaging each dose of medication, so that their successive execution allows stable packaging even when the total volume of each dose of medication for making a package is bigger than the packaging volume of any medication envelope established in the automatic medicine packaging machine.

In the step S1 of acquiring the packaging volume of each medication envelope, after extracting packaging size of each medication envelope, the packaging volume of each medication envelope corresponding to the extracted packaging size is acquired from data of packaging volumes of medication envelopes that are preserved in advance. The data of packaging volumes of medication envelopes are reserved in a storage unit which is connected to a controller C by computing maximum allowable volume of medications corresponding to each packaging size established in the automatic medicine packaging machine, that is, the size of each medication envelope.

In the step S2 of computing total volume of each dose of medication, after extracting name and number of each dose of medication from prescription data inputted from a server computer S, the total volume of each medication for making a package may be computed from data of total volumes of medications that are preserved in advance. The data of total volumes of medications are reserved in the storage unit connected to the controller C by measuring volume of each tablet of medication housed in tablet cassettes of the automatic medicine packaging machine. The total volume of each dose of medication can be calculated by multiplying the volume of each tablet by the number of tablets of each dose of medication.

In the step S3 of judging excess volume of each dose of medication, the judgment of excess volume of each dose of medication is performed by comparing the acquired packaging volume of each medication envelope with the computed total volume of each dose of medication. In other words, this step is to judge by volume comparison and analysis whether the computed total volume of each dose of medication exceeds the packaging volume of any medication envelope established in the automatic medicine packaging machine.

In the step S4 of division-packaging each dose of medication, if the total volume of each dose of medication for making a package is bigger than the packaging volume of any medication envelope, then each dose of medication will be divided and packaged into two medication envelopes. In other words, this step enables smooth and stable packaging of each dose of medication by division-packaging of each dose of medication into two medication envelopes because it is not possible to package each dose of medication in a single medication envelope without problems when the total volume of each dose of medication for making a package is bigger than the packaging volume of any medication envelope.

This division-packaging method further includes step S5 of indicating division-packaging status on each division-packaged medication envelope. This step lets users smoothly recognize the division-packaging status and take each dose of medication in a precise manner. The indication of the division-packaging status is simply performed by printing on the fronts of two medication envelopes of each medication package.

This division-packaging method further includes step S6 of displaying existence of division-packaged medication packages after accomplishing the step S4. This step makes operators recognize the division-packaging status in an easy manner due to the excess volume of each dose of medication. Afterward this may be used as useful data for examining medication packages by printing out the list of division-packaged medication packages.

Figure 2:
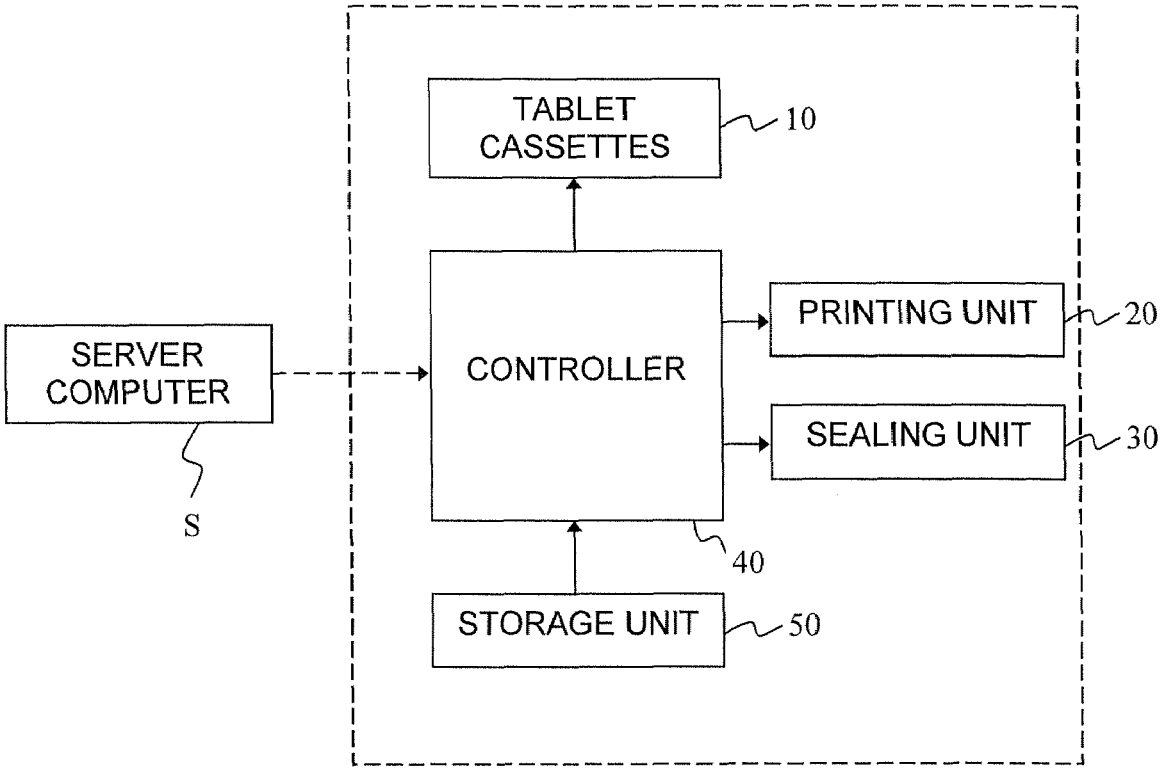
FIG. 2 is a block diagram of an apparatus for division-packaging for an automatic medicine packaging machine according to the present invention.
Figure 3:
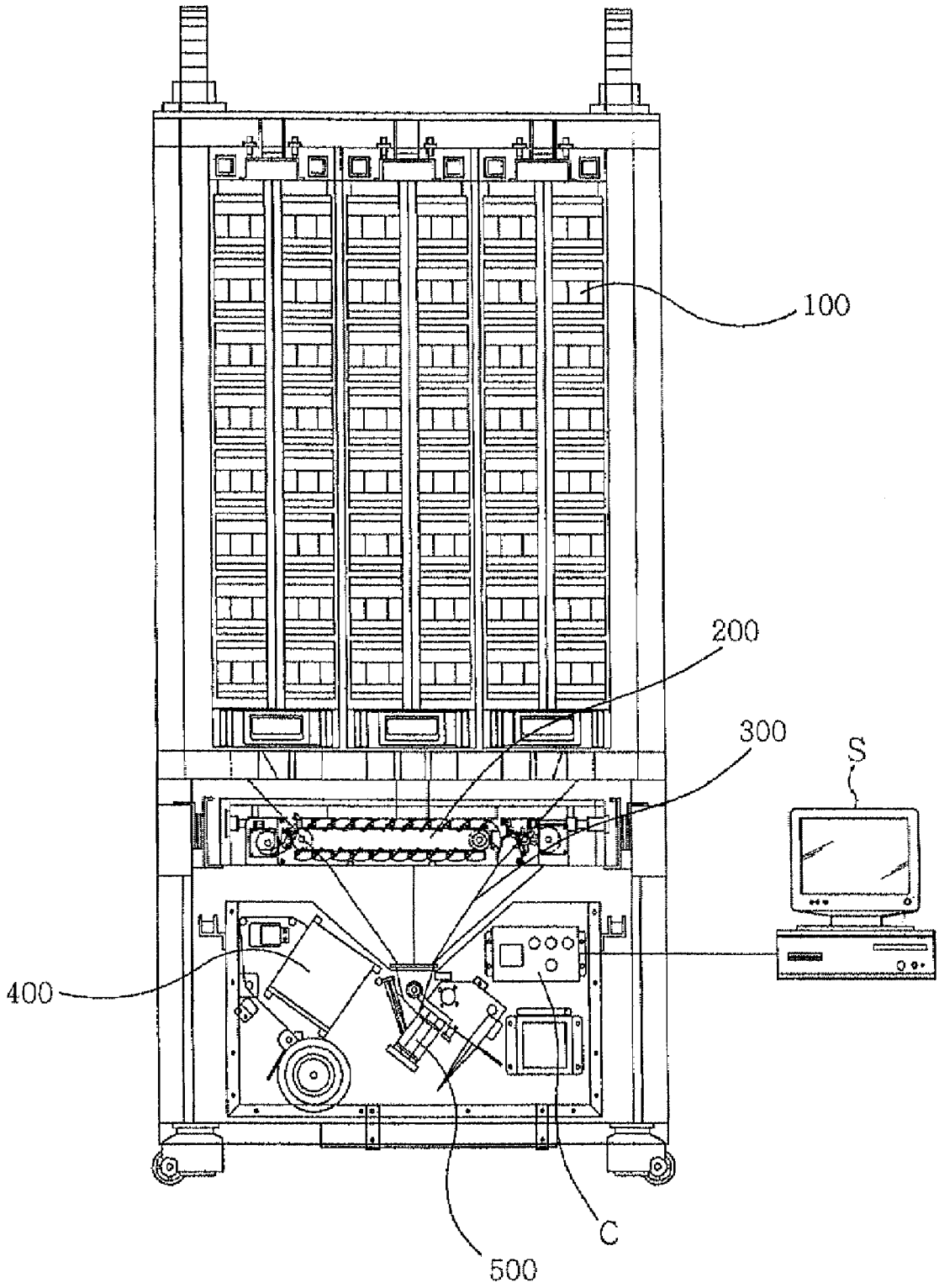
FIG. 3 is an elevation view of an automatic medicine packaging machine.

Referring FIG. 2, a division-packaging apparatus for an automatic medicine packaging machine includes a plurality of tablet cassettes 10 that houses medications; a printing unit 20 that prints instruction labels on medication envelopes; a sealing unit 30 that feeds and seals medication envelopes on which instruction labels are printed by the printing unit 20; a controller 40 of the automatic medicine packaging machine 1, which controls the tablet cassettes 10, the printing unit 20, and the sealing unit 30 of the automatic medicine packaging machine 1 according to the prescription data that are inputted by a server computer S; and a storage unit 50, which is connected to the controller 40, that stores the data of volumes of medications and of medication envelopes. The automatic medicine packaging machine 1 is a device to package each dose of medication continuously by the controller 40's controlling of the parts.

The storage unit 50 is connected to the controller 40, in which stored are the data of packaging volumes of medication envelopes corresponding to each packaging size and the data of total volumes of medications housed in tablet cassettes. Those data are inputted and stored as data files in advance by users or operators.

The controller 40 controls the tablet cassettes 10 and the sealing unit 30 to divide and package each dose of medication into two packaging envelopes if the total volume of each dose of medication for making a package is bigger than the packaging volume of any medication packaging envelope after acquiring from the storage unit 50 the total volume of each dose of medication and the packaging volume of medication envelopes corresponding to each packaging size established in the automatic packaging machine 1. In other words, the total volume of each dose of medication for making a package can be calculated by multiplying the volume of each tablet by the number of tablets of each dose of medication after extracting medication information from the prescription data and acquiring the volume of each tablet from the data of total volumes of medications.

The controller 40 controls the printing unit 20 to print division-packaging status on the fronts of two packaging envelopes in which each dose of medication is divided and packaged. That is, by printing the division-packaging status on the fronts of two packaging envelopes through the printing unit 20 installed in the automatic packaging machine 1 users may smoothly recognize the division-packaging status and take each dose of medication in a precise manner.

What is claimed is:

1. A division-packaging method for an automatic medicine packaging machine including steps of:

a) acquiring packaging volume of each medication envelope, wherein, after extracting packaging size of each medication envelope, the packaging volume of each medication envelope corresponding to the extracted packaging size is acquired from data of packaging volumes of medication envelopes that are preserved in advance;

b) computing total volume of each dose of medication, wherein, after extracting name and number of each dose of medication from prescription data inputted from a server computer, the total volume of each dose of medication for making a package is computed by acquiring data of total volumes of medications which are preserved in advance;

c) judging excess volume of each dose of medication, wherein the judgment of excess volume of each dose of medication is performed by comparing the acquired packaging volume of each medication envelope with the computed total volume of each dose of medication; and d) division-packaging each dose of medication into two or more medication envelopes when the total volume of each dose of medication for making a package is bigger than the packaging volume of any medication envelope established in the automatic medicine packaging machine.

2. The method of claim 1, further comprising step of indicating division-packaging status on each division-packaged medication envelope.

3. The method of claim 2, wherein the indication of the division-packaging status is performed by printing on the fronts of the two or more medication envelopes of each medication package.

4. The method of claim 1, further comprising step of displaying existence of division-packaged medication packages after the step of division-packaging each dose of medication into the two or more medication envelopes.

* * * * *